US007219477B2

(12) United States Patent
Leffler

(10) Patent No.: US 7,219,477 B2
(45) Date of Patent: May 22, 2007

(54) SIDING TRIM

(76) Inventor: Scott T. Leffler, 120 Pachaug River Dr., Griswold, CT (US) 06351

( * ) Notice: Subject to any disclaimer, the term of this patent is extended or adjusted under 35 U.S.C. 154(b) by 343 days.

(21) Appl. No.: 10/647,099

(22) Filed: Aug. 22, 2003

(65) Prior Publication Data

US 2005/0115189 A1 Jun. 2, 2005

(51) Int. Cl.
*E04C 2/38* (2006.01)
*E04B 1/38* (2006.01)

(52) U.S. Cl. ..... 52/716.1; 52/277; 52/279; 52/282.1; 52/285.1

(58) Field of Classification Search ..... 52/716.1, 52/277, 279, 282.1, 285.1; D25/119, 125
See application file for complete search history.

(56) References Cited

U.S. PATENT DOCUMENTS 1,521,938 A 1/1925 Gartenberg
3,035,446 A * 5/1962 Ross ..... 73/866.3
3,456,409 A 7/1969 Piget ..... 52/282
3,471,982 A * 10/1969 Strozewski ..... 52/282.4
3,485,001 A * 12/1969 Miller ..... 52/281
3,500,600 A * 3/1970 Bagley, Sr. ..... 52/58
3,603,054 A * 9/1971 Didry ..... 52/282.1
3,855,746 A * 12/1974 Leggiere ..... 52/213
4,103,524 A 8/1978 Mitchell et al. ..... 70/209
4,189,885 A 2/1980 Fritz ..... 52/287
4,339,898 A * 7/1982 Pichette ..... 52/94
D318,742 S * 7/1991 Miller ..... D26/140
5,090,174 A * 2/1992 Fragale ..... 52/309.9
5,519,969 A * 5/1996 Golba ..... 52/60
5,586,415 A 12/1996 Fisher et al. ..... 52/58
5,694,728 A 12/1997 Heath, Jr. et al. ..... 52/554
5,966,891 A 10/1999 Fagan et al. ..... 52/656.9
6,125,605 A * 10/2000 Young ..... 52/717.01

* cited by examiner

*Primary Examiner*—Richard E. Chilcot, Jr.
*Assistant Examiner*—Lindsay M. Maguire
(74) *Attorney, Agent, or Firm*—Nicole E. Coppes-Gathy

(57) ABSTRACT

Siding trim including at least three trim elements each having at least two recesses associated therewith. The at least two recesses share a traversing frame element. The traversing frame element has at least two projecting elements projecting outwardly therefrom. The at least two recesses selectively receive and retain one or more panel elements. The at least two recesses bias against the one or more panel elements to firmly retain the one or more panel elements therein.

7 Claims, 3 Drawing Sheets

SIDING TRIM

BACKGROUND OF THE INVENTION

1. Field of the Invention

The present invention generally relates to outdoor roof and wall coverings. More particularly, the present invention relates to siding trim that is cooperative with various roof and wall coverings.

2. Description of the Prior Art

Outdoor roof and wall coverings are well known. Whether the covering is aluminum, vinyl, plastic coated metal, steel or some other type of similar material, siding trim is generally required to properly install the covering and to provide a clean finish. Types of siding trim include, for example, inside/outside corners, J-channels, drip caps, starter strips, utility trims, fascia caps, L-channels, F-channels, C-channels, sill covers and a variety of other similar components.

Some of the shortcomings often associated with conventional siding trim include: (1) difficulty removing and replacing damaged siding and/or trim components, (2) inefficient and complicated installation, (3) inefficient use of material (e.g., multiple trim strips on soffits), and (4) limited weather resistance (e.g., water can penetrate between multiple trim strips). Efforts have been made to address these shortcomings. See, for example, U.S. Pat. Nos. 3,855,746; 4,189,885, and/or 5,966,891. Notwithstanding that which has been done, there continues to be a need for siding trim that is economical and efficient, that is suitable for providing greater flexibility in application or installation, and that improves the stability and overall appearance of the covering.

SUMMARY OF THE INVENTION

It is an object of the present invention to provide siding trim that overcomes the above noted shortcomings by providing greater flexibility in use.

It is another object of the present invention to provide siding trim that improves the overall stability and appearance of an installed covering.

These and other objects and advantages of the present invention are achieved by a system of trim elements. The trim elements are preferably cooperative with any of a variety of roof or wall coverings. The trim elements preferably include at least three trim elements, a first trim element providing a first utility, a second trim element providing a second utility, and a third trim element providing a third utility.

The first trim element has a first section defining a first slot or recess and a second section defining a second slot or recess. Preferably, the first and second recesses share at least two frame elements, an intermediate element and a traversing element. Preferably, first recess opens in a direction substantially away from the traversing element and the second recess opens in a direction substantially parallel to the traversing element. First and second recesses of the first trim element preferably open at substantially right angles relative to each other.

The second trim element has a first section defining a first slot or recess and a second section defining a second slot or recess. Preferably, the first and second recesses of the second trim element share at least one frame element or a traversing element. Preferably, first recess opens in a direction substantially away from the traversing element and the second recess opens in a direction substantially parallel to the traversing element. First and second recesses of the second trim element preferably open at substantially right angles relative to each other.

The third trim element has a first section defining a first slot or recess and a second section defining a second slot or recess. Preferably, the first and second recesses of the third trim element are substantially parallel and open in substantially the same direction. That is, the first and second recesses preferably share at least one frame element or a traversing element. Preferably, both first and second recesses of the third trim element open in a direction substantially away from the traversing element.

In the broad sense, the present invention is a system of at least three trim elements suitable for structurally joining adjacent panel elements such that the panels remain in mutually independent planes in an aesthetically pleasing sound structural manner. More particularly, the present invention is a trim element having at least two recesses. Each recess preferably opens in an independent plane and is preferably suitable to receive and retain a panel element.

BRIEF DESCRIPTION OF THE DRAWINGS

Other and further objects, advantages and features of the present invention will be understood by reference to the following specification in conjunction with the accompanying drawings, in which like reference characters denote like elements of structure.

DETAILED DESCRIPTION OF THE INVENTION

Figure 1:
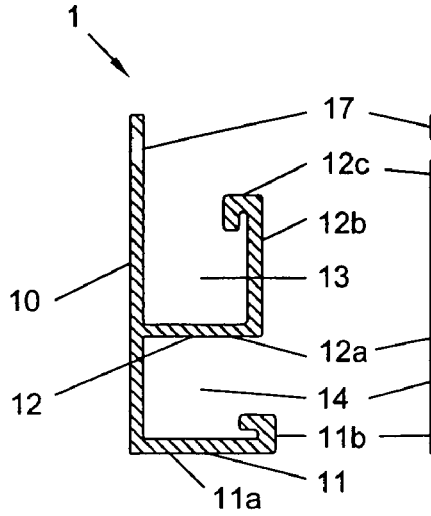
FIG. 1 is a side sectional view of a first trim element in accordance with an illustrative embodiment of the present invention.

Referring to the drawings and, in particular to FIGS. 1 through 6, there is shown an illustrative embodiment of a first trim element generally represented by reference numeral 1. The basic cross-sectional shape of first trim element 1 is clearly shown in FIG. 1. As shown in FIG. 1, trim element 1 has a traversing element 10 with at least two projecting elements projecting on the same side and outwardly or away from the traversing element 10. The at least two projecting elements include an outer element 11 at an end the traversing element 10 and an L-shaped element 12 spaced from and having a first 12*a* substantially parallel to outer element 11.

Outer element 11 preferably has at least one arm 11*a* and at least one flange 11*b*. Flange 11*b* is preferably formed such that a portion thereof is substantially perpendicular to traversing element 10 with another portion thereof substantially parallel with traversing element 10.

L-shaped element 12 preferably has at least one first arm 12*a* connected to traversing element 10, at least one second arm 12*b* connected to first arm 12*a*, and at least one flange 12*c*. Arms 12*a* and 12*b* are preferably disposed at substantially right angles with respect to each other and flange 12*c* is preferably formed such that a portion thereof is substantially perpendicular to traversing element 10 with another portion thereof substantially parallel with traversing element 10.

Traversing element 10 and L-shaped element 12 preferably form a first recess 13 with a second recess 14 being formed by the traversing element, L-shaped element 12 and outer element 11. Outer element 11 and L-shaped element 12 preferably project away from traversing element 10 in the same direction relative to each other such that the two recesses open in substantially different planes relative to each other.

First trim element 1 can be fashioned from any of a variety of materials, including for example, aluminum, vinyl, plastic coated metal or steel. First trim element 1 can be formed in any of a variety of ways (e.g., extrusion molding). It is preferable that first trim element 1 have at least some flexible characteristics. For example, preferably both outer element 11 and L-shaped element 12 have a bias associated therewith. Preferably, this bias facilitates securely retaining a panel element 15 in first recess 13 and/or second recess 14. It is noted that this bias can be accomplished in any of a variety of ways. For example, flange 11*b* of outer element 11 and/or flange 12*c* of L-shaped element 12 can be suitably flexible and resilient to bias against panel element 15 such that the panel element is firmly held in place in first recess 13 and/or second recess 14.

First recess 13 and second recess 14 can be formed to accommodate any of a variety of different panel elements. First recess 13 and second recess 14 preferably open in mutually perpendicular planes relative to each other. For example, first recess 13 can open in a direction substantially parallel with traversing element 10, and second recess 14 can open in a direction substantially perpendicular to traversing element 10.

Figure 6:
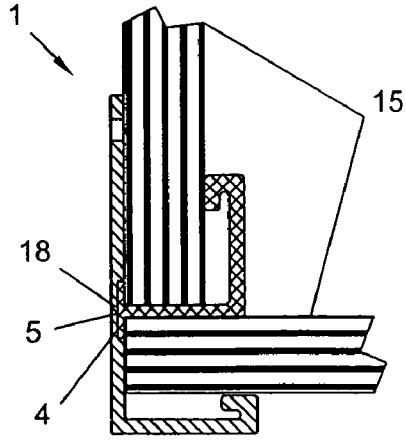
FIG. 6 illustrates a use of the first trim element of FIG. 1, showing an alternative illustrative embodiment.

Referring to the alternative embodiment shown in FIG. 6, L-shaped element 12 can be separably connected to traversing element 10 at connection 18. Connection 18 can, for example, be a tongue-and-groove type connection in which L-shaped element 12 has a tongue 4 for slidingly cooperating with one or more grooves 5 associated with traversing element 10. Other connection types may also be used (e.g., a snap-fit connection). Preferably, connection 18 facilitates greater flexibility in use. For example, one or more grooves 5 can be spaced to accommodate or support L-shaped element 12, via tongue 4, in different positions relative to outer element 11 such that differently sized/dimensioned panel elements 15 can accommodated by recess 14.

Figure 2:
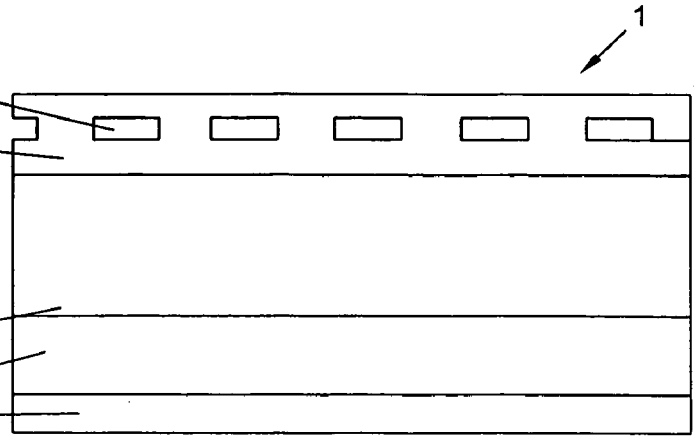
FIG. 2 is a front view of the first trim element of FIG. 1.
Figure 3:
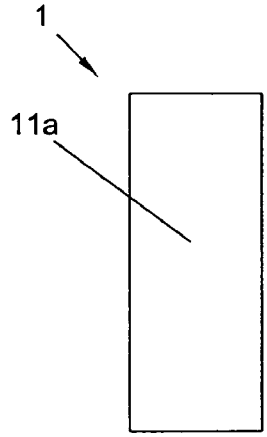
FIG. 3 is a first plan view of the first trim element of FIG. 1.
Figure 4:
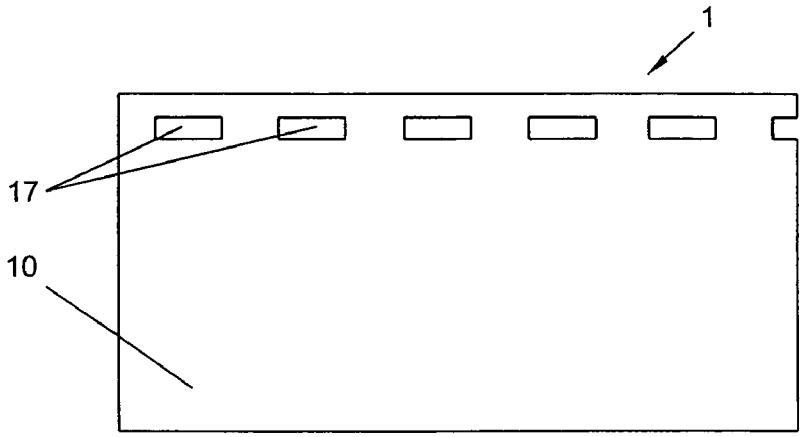
FIG. 4 is a rear view of the first trim element of FIG. 1.
Figure 5:
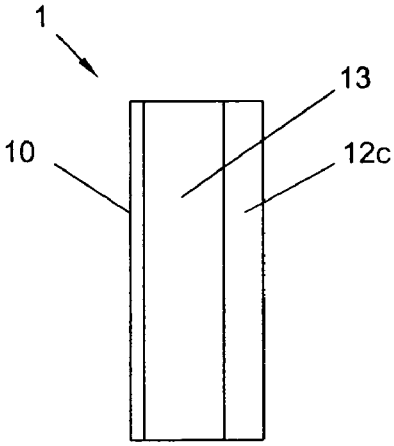
FIG. 5 is a second plan view, opposite the first plan view, of the first trim element of FIG. 1.

As clearly shown in FIGS. 2 and 4, traversing element 10 preferably has a number of holes 17 formed therein. Holes 17 are preferably suitable to accommodate any of a variety of fasteners (e.g., nails, bolts, screws, etc.) to facilitate in the installation of first trim element. Holes 17 can be appropriately sized, shaped or configured to cooperate with the various fasteners.

Figure 7:
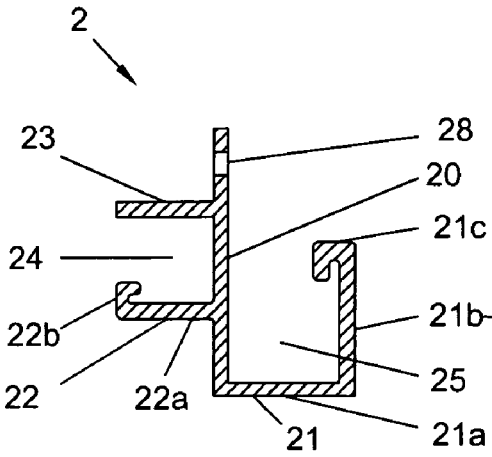
FIG. 7 is a side sectional view of a second trim element in accordance with another illustrative embodiment of the present invention.

FIGS. 7 through 12 show an illustrative embodiment of a second trim element generally represented by reference numeral 2. The basic cross-sectional shape of second trim element 2 is clearly shown in FIG. 7. As FIG. 7 shows, second trim element 1 has a traversing element 20 with at least three projecting elements. The at least three projecting elements preferably include an outer L-shaped element 21 at an end thereof, a first central element 22, and a second central element 23. Both central elements 22, 23 are spaced from the outer L-shaped element.

Outer L-shaped element 21 preferably has at least one first arm 21*a* connected to traversing element 20, at least one second arm 21*b* connected to first arm 21*a*, and at least one flange 21*c*. Arms 21*a* and 21*b* are preferably disposed at substantially right angles with respect to each other and flange 21*c* is preferably formed such that a portion thereof is substantially perpendicular to traversing element 20 with another portion thereof substantially parallel to traversing element 20.

First central element 22 preferably has at least one arm 22*a* and at least one flange 22*b*. Flange 22*b* is preferably formed such that a portion thereof is substantially perpendicular to traversing element 20 with another portion thereof substantially parallel with the traversing element. Alternatively, although not shown in the drawings, second central element 23 can also have a configuration similar to that of first central element 22.

Central elements 22, 23 preferably form a first recess 24 with the traversing element 20. Traversing element 20 and outer L-shaped element 21 preferably form a second recess 25. Outer L-shaped element 21 and central elements 22, 23 preferably project away from traversing element 20 in opposing directions relative to each other such that the two recesses open in substantially different planes.

Second trim element 2, like first trim element 1, can be made from any of a variety of materials, including, aluminum, vinyl, plastic coated metal or steel, and can be formed in any of a variety of ways (e.g., extrusion molding). It is preferable that second trim element 2 have at least some flexible characteristics. For example, preferably outer L-shaped element 21 and at least one of central elements 22, 23 have a bias associated therewith. Preferably, this bias, which can be accomplished in a variety of ways, facilitates securely retaining a panel element 26 in first recess 24 and/or second recess 25.

For example, flange 21*c* of L-shaped element 21 and/or flange 22*a* of first central element 22 can be configured to be suitably flexible and resilient to bias against one or more panel elements 26 such that the panel elements are firmly held in place in first recess 24 and/or second recess 25.

Similar to first and second recesses 13 and 14, first recess 24 and second recess 25 can accommodate any of a variety of different panel elements. First recess 24 and second recess 25 preferably open in mutually perpendicular planes relative to each other. For example, first recess 24 can open in a direction substantially perpendicular to traversing element 20, and second recess 25 can open in a direction substantially parallel to traversing element 20. Further, trim element 2 has a shape notably different from trim element 1.

Figure 12:
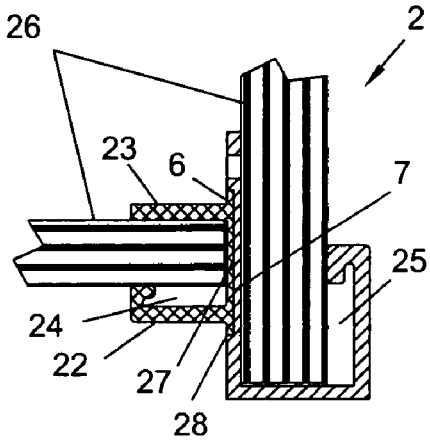
FIG. 12 illustrates a use of the second trim element of FIG. 7, showing an alternative illustrative embodiment.
Figure 13:
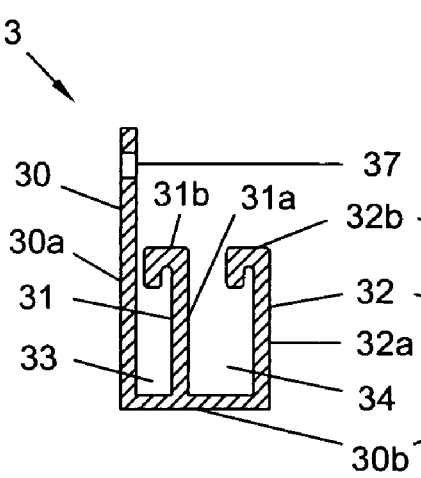
FIG. 13 is a side sectional view of a third trim element in accordance with another illustrative embodiment of the present invention.

Referring to FIG. 12, in this alternative embodiment central elements 22, 23 are connected by a connecting element 27 to make recess 24 an integral U-shaped structure. This U-shaped structure is preferably separably connectable with traversing element 20 at a connection 28. This connection 28 can, for example, be a tongue-and-groove type connection in which the U-shaped structure has a tongue 6 for slidingly cooperating with one or more grooves 7 associated with traversing element 10. It is noted that one or more grooves 7 can be spaced to accommodate or support recess 24, via tongue 6, in different positions along traversing element 20 and relative to outer element 21 so that recess 24 can be adjustably positioned. Connection 28 can be of any of a variety of other configurations, such as for example, a snap-fit type connection. Thus, connection 28 facilitates greater flexibility in use.

Figure 8:
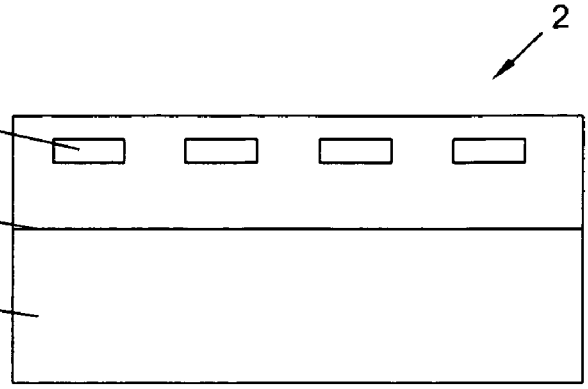
FIG. 8 is a front view of the second trim element of FIG. 7.
Figure 9:
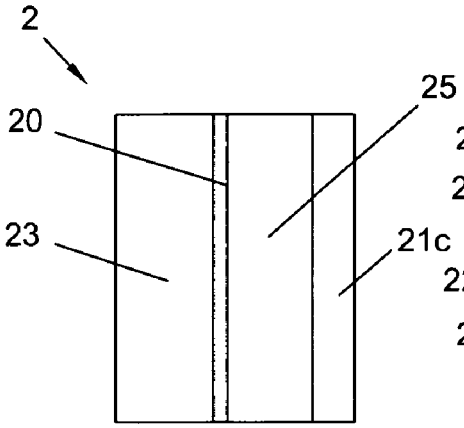
FIG. 9 is a first plan view of the second trim element of FIG. 7.
Figure 10:
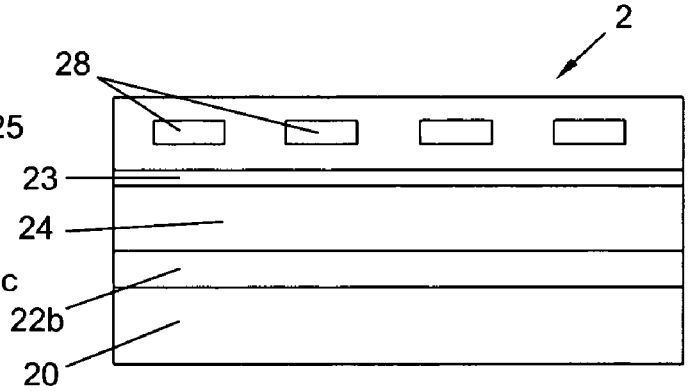
FIG. 10 is a rear view of the second trim element of FIG. 7.
Figure 11:
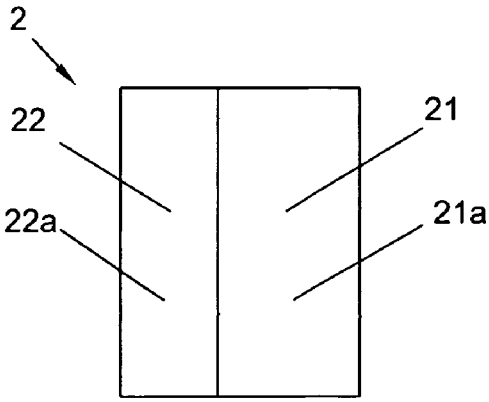
FIG. 11 is a second plan view, opposite the first plan view, of the second trim element of FIG. 7.

As clearly shown in FIGS. 8 and 10, traversing element 20 preferably has a number of holes 28 formed therein. Holes 28 are preferably suitable to accommodate any of a variety of fasteners (e.g., nails, bolts, screws, etc.) to facilitate in the installation of first trim element. Holes 28 can be appropriately sized, shaped or configured to cooperate with the various fasteners.

Referring to FIGS. 13 through 18, there is shown an illustrative embodiment of a third trim element generally represented by reference numeral 3. The basic cross-sectional shape of third trim element 3 is clearly shown in FIG. 13. As shown, third trim element 3 preferably has an L-shaped traversing element 30 with at least two projecting elements projecting away or outwardly on the same side of the L-shaped traversing element 30. The at least two projecting elements preferably include an inner element 31 and an outer element 32 at an end of the L-shaped traversing element and spaced from and substantially parallel with inner element 31.

L-shaped traversing element 30 preferably has at least one first arm 30*a* and at least second arm 30*b*. Arms 30*a* and 30*b* are preferably disposed at substantially right angles with respect to each other. Preferably, inner element 31 and outer element 32 project outwardly from second arm 30*b*, but may also project from first arm 30*a*.

Inner element 31 preferably has at least one arm 31*a* and at least one flange 31*b*. Flange 31*b* is preferably formed so that a portion thereof is substantially perpendicular to arm 31*a* with another portion thereof being substantially parallel to arm 31*a*.

Outer element 32 is preferably substantially identical to inner element 31, and thus preferably has at least one arm 32*a* and at least one flange 32*b*. Flange 32*b* is preferably formed so that a portion thereof is substantially perpendicular to arm 32*a* with another portion thereof being substantially parallel to arm 32*a*.

Inner element 31 and L-shaped traversing element 30 preferably form a first recess 33 with a second recess 34 being formed by inner element 31, outer element 32 and traversing element 30. Inner element 31 and outer element 32 preferably project away from L-shaped traversing element 30 in the same direction such that the two recesses open in substantially same planes relative to each other. Preferably, second recess 34 opens in a plane independent from the opening of first recess 33. Preferably, both outer element 32 and inner element 31 project away from traversing element 30 in a substantially parallel manner.

Third trim element 3 can be fashioned from any of a variety of materials, including for example, aluminum, vinyl, plastic coated metal or steel. Third trim element 3 can be formed in any of a variety of ways (e.g., extrusion molding). It is preferable that third trim element 3 have at least some flexible characteristics. For example, referring in particular to FIGS. 13 and 18, preferably inner element 31 and outer element 32 have a bias associated therewith. Preferably, this bias facilitates securely retaining a panel element 35 in first recess 33 and/or second recess 34. It is noted that this bias can be accomplished in any of a variety of ways. For example, flange 31*b* of inner element 31 and/or flange 32*b* of outer element 32 can be suitably flexible and resilient to bias against panel element 35 such that panel element 35 is firmly held in place in first recess 33 and/or second recess 34.

First recess 33 and/or second recess 34 can be formed to accommodate any of a variety of different panel elements. First recess 33 and second recess 34 preferably open in mutually parallel planes relative to each other. For example, first recess 33 can open in a direct substantially parallel with L-shaped traversing element 30 as clearly shown in FIG. 13, and second recess 34 can likewise open in a direction substantially parallel to L-shaped traversing element 30.

Figure 18:
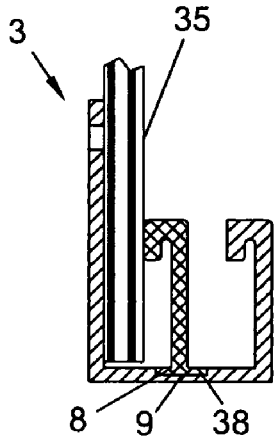
FIG. 18 illustrates a use of the third trim element of FIG. 13, showing an alternative illustrative embodiment of the present invention.

Referring to alternative embodiment of FIG. 18, inner element 31 can be separably connected to traversing element 30 at connection 38. Connection 38 can, for example, be a tongue-and-groove type connection in which inner element 31 has a tongue 8 for slidingly cooperating with one or more grooves 9 associated with traversing element 30. It is noted that grooves 9 can be spaced to accommodate or support inner element 31, via tongue 8, in different positions relative to outer element 32 and/or L-shaped traversing element 30 so that recess 33 and/or recess 34 can be adjustably sized/dimensioned to accommodate various panel elements 35. Other connection types may also be suitable (e.g., a snap-fit connection). Thus, connection 18 facilitates greater flexibility in use.

Figure 14:
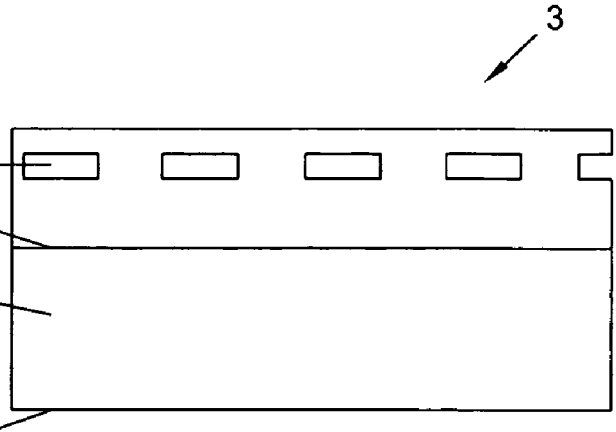
FIG. 14 is a front view of the third trim element of FIG. 13.
Figure 15:
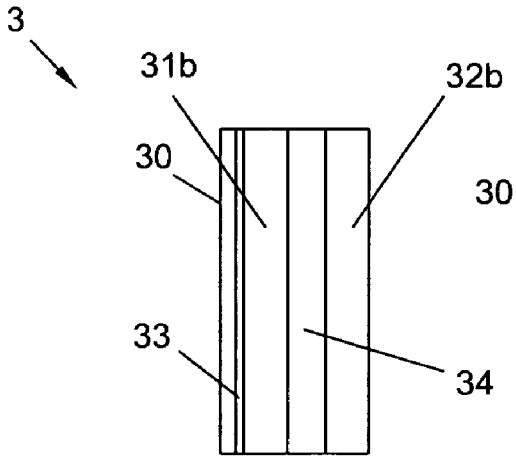
FIG. 15 is a first plan view of the third trim element of FIG. 13.
Figure 16:
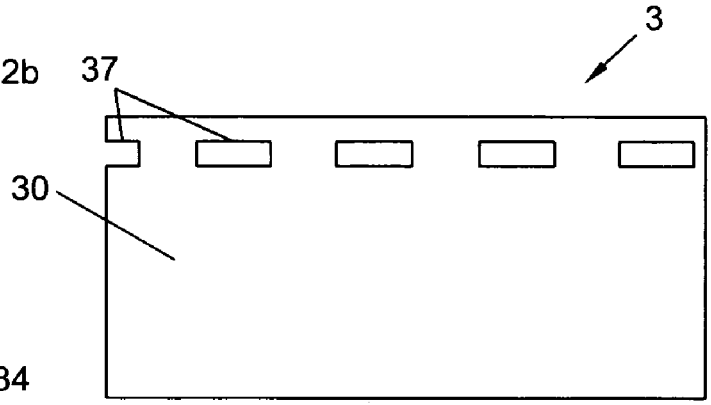
FIG. 16 is a rear view of the third trim element of FIG. 13.
Figure 17:
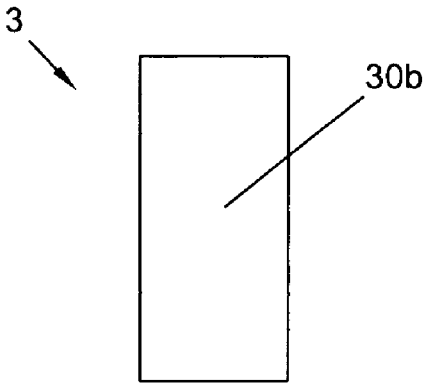
FIG. 17 is a second plan view, opposite the third plan view, of the third trim element of FIG. 13.

As clearly shown in FIGS. 14 and 16, traversing element 30 preferably has a number of holes 37 formed therein. Holes 37 are preferably suitable to accommodate any of a variety of fasteners (e.g., nails, bolts, screws, etc.) to facilitate in the installation of third trim element 3. Holes 37 can be appropriately sized, shaped or configured to accommodate and/or cooperate with the various fasteners.

Having described some of the preferred characteristics of an illustrative embodiment of each trim element, the utility associated with each element preferably includes at least the following.

First trim element 1 is preferably a finishing element for providing support to a panel or structural component. For example when used for installing vinyl siding first trim element 1 combines the utilities associated with conventionally used J-channel and F-channel accessories and eliminates the need for using a starter strip and aluminum coil stock. First trim element 1 is ideal for use in either and/or both horizontal and vertical type panel installations. First trim element 1 is optimal for both new construction and remodeling.

Second trim element 2, like first trim element 1, is preferably a finishing element for providing support to a panel or structural component such as a soffit. However, second trim element 2, with recesses 24 and 25 opening on different sides of traversing element 20, preferably provides a distinct utility from that provided by the first trim element. For example, when second trim element 2 is used in the installation of vinyl siding, second trim element 2 is particularly well suited for two story building constructions, such as for example, a raised-ranch construction, a colonial construction, or a split level construction. That is, second trim element 2 can eliminate the need for modifying conventionally used elements (e.g., soffit receivers) and/or employing additional elements (e.g., utility trim) in order to properly receive and retain a panel structure such as soffit. Second trim element 2 is therefore more efficient and economical to use as it reduces material costs and better resists the negative effects of weather, both of which are often enhanced by modifying a conventional element to accomplish a utility for which it was not designed or intended.

Third trim element 3, like the first and second trim elements, is preferably a finishing element for supporting a panel or structural component such as a soffit. Preferably, third trim element combines the utilities conventionally associated with a J-channel accessory and an under sill trim or C-channel accessory. In the installation of vinyl siding, for example, third trim element 3 is well suited for use above doors as well as above and below windows.

In sum, first trim element 1, second trim element 2, and third trim element 3 can be separately employed or combined and used as a system to streamline any of a variety of structurally joining adjacent panel elements so that the panels remain in mutually independent planes in an aesthetically pleasing sound structural manner.

The present invention having been thus described with particular reference to the preferred forms thereof, it will be obvious that various changes and modifications may be made therein without departing from the spirit and scope of the present invention as defined herein.

What is claimed is:

1. A siding trim element comprising:

A traversing element with at least two projecting elements projecting outwardly therefrom, said traversing element and said at least two projecting elements forming at least two recesses which receive and retain one or more siding panel elements, each of said at least two projecting elements comprising a flange formed integral with an end of each of said at least two projecting elements, wherein a portion of each of said flange is substantially perpendicular to said traversing element and another portion of said flange is substantially parallel with said traversing element, wherein said at least two recesses bias against said one or more panel elements to soundly retain said one or more siding panel elements therein, and wherein said traversing element forms a rear portion of said one of said at least two recesses and a side portion of another of said at least two recesses.

2. The siding trim of claim 1, wherein said at least two projecting elements project from one side of said traversing element.

3. The siding trim of claim 1, wherein one of said at least two recesses opens in a direction substantially away from said traversing element.

4. The siding trim of claim 3, wherein another of said at least two recesses opens in a direction substantially parallel with said traversing element.

5. The siding trim of claim 1, wherein said at least two recesses open at substantially right angles to each other.

6. The siding trim of claim 1, wherein said at least two recesses open in substantially different planes.

7. The siding trim of claim 1, wherein said at least two recesses each open in a different direction relative to said traversing element.

* * * * *